US005450779A

United States Patent [19]

Yancy

[11] Patent Number: 5,450,779

[45] Date of Patent: Sep. 19, 1995

[54] WIND CHIME HAVING CHIME RETAINERS

[76] Inventor: Bill Yancy, 3741 Seabrook Island Rd., Johns Island, S.C. 29455

[21] Appl. No.: 306,952

[22] Filed: Sep. 16, 1994

[51] Int. Cl.[6] ..... G10D 13/08; G10K 5/00

[52] U.S. Cl. ..... 84/404; 116/141; D17/22; D10/116; D11/141

[58] Field of Search ..... 84/402, 404; 116/141, 116/169; D17/22, 99; 446/418; D10/116, 119; D11/141

[56] References Cited

U.S. PATENT DOCUMENTS

D. 285,669 9/1986 Brockmann ..... D10/116

*Primary Examiner*—Steven L. Stephan
*Assistant Examiner*—Cassandra C. Spyrou
*Attorney, Agent, or Firm*—B. Craig Killough

[57] ABSTRACT

A wind chime having a plurality of tubes which produce musical tones and which are suspended from a frame to allow movement of the tubes. The tubes produce a musical tone when the tubes contact a striker which is in the form of one or more loops through which the tubes extend, and in which the individual tubes are retained.

11 Claims, 1 Drawing Sheet

WIND CHIME HAVING CHIME RETAINERS

FIELD OF THE INVENTION

This invention relates to wind chimes.

BACKGROUND OF THE INVENTION

Wind chimes are devices which are hung or suspended, usually outdoors, and which produce musical tones as the device is moved about by the wind. Generally, a striker is connected to a clapper, and as the clapper is moved about by the wind, it causes the striker to be blown into and against chimes, producing musical tones.

Wind chimes are characterized by a frame which is hung or suspended so that movement of the wind chime is not impeded by other objects. A plurality of chimes, usually four or more, are suspended from the frame. Most commonly, the chimes are hollow metallic tubes which are suspended vertically from the frame in a manner which allows movement of the tubes relative to the frame and relative to each other.

The plurality of tubes forms a boundary as determined by their position of suspension from the frame. Generally, the hollow tubes are suspended equidistant from each other, so that, for example, if four tubes are used, the four tubes form the boundary of a square, while five tubes form the boundary of a pentagon, and so on. However, other formations may be used, such as a side by side alignment of the tubes. The chimes are capable of movement relative to each other, with little or no interference in the movement of the chimes caused by the remaining chimes. The striker is suspended, such as from the frame or from the hanging means of the wind chime, and is present within the interior of the boundary formed by the wind tubes, generally in the center of the boundary. The striker is allowed to swing freely so as to strike the plurality of chimes.

The movement of the striker to strike the chimes is influenced by the clapper. The clapper is generally a disk or similar plane which is suspended horizontally to result in maximum exposure to the wind. As the wind contacts and pushes the clapper about, the striker is moved so as to strike the chimes to produce musical tones. The clapper may be decorative in shape or appearance. The device is enhanced by the production of multiple tones. Various wind chimes are known in the art which use hollow tubes of varying dimensions form chimes which produce varying tones. The length or diameter of a hollow tube will affect the musical tone produced, and produce multiple tones.

The hollow tubes which form the chimes are allowed freedom of movement by means of their vertical suspension. This freedom of movement may result in the chimes becoming blown about in an undesired manner, and becoming entangled.

SUMMARY OF THE PRESENT INVENTION

The present invention is a plurality of tubes or chimes each of which are hung or suspended from above, usually by means of a string, line, wire or similar means. Each chime extends through a loop. The loops are joined in a series. The series of loops acts as striker which causes the chimes to produce musical tones as the chimes and/or striker moves into and contact with each other. The loop configuration of the striker retains the individual chime within its corresponding loop, preventing the individual chimes from becoming entangled with each other.

DETAILED DESCRIPTION OF THE PREFERRED EMBODIMENT

Figure 1:
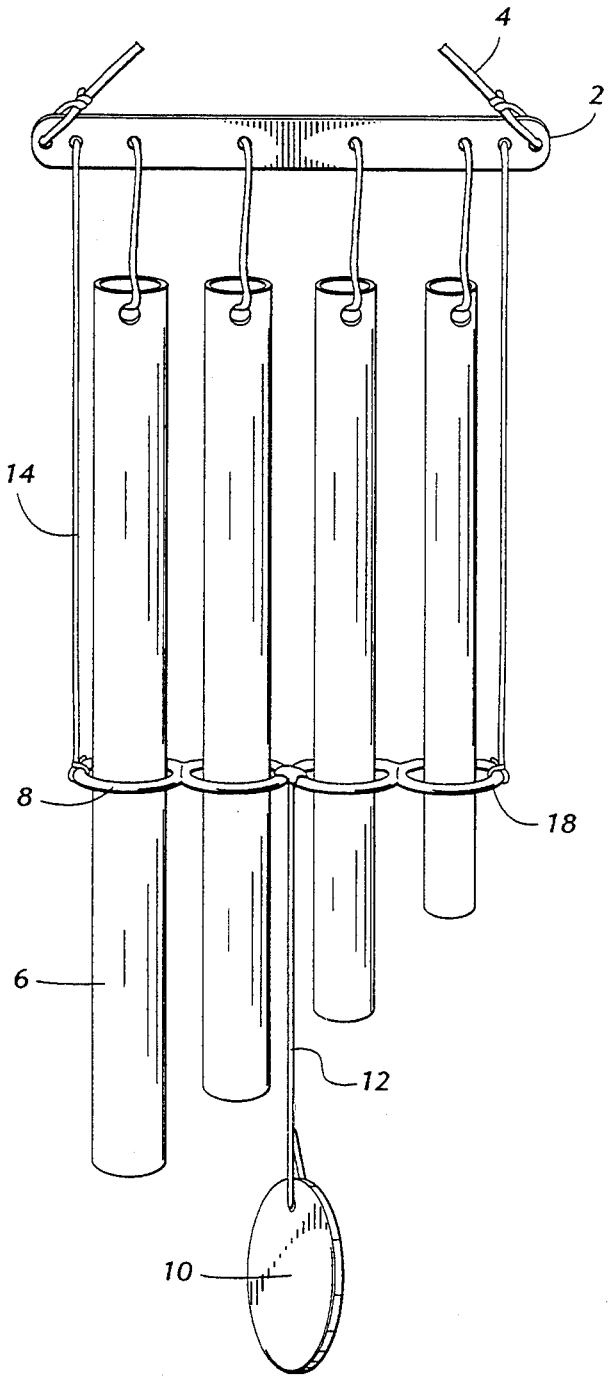
FIG. 1 is a perspective view of a wind chime incorporating one embodiment of the striker.

Referring now to the drawing figures, FIG. 1 shows a wind chime. A frame 2 is suspended by means of a line 4. The line can be a string, rope, chain, rod or other similar flexible member from which objects are commonly hung, and which will support the weight of the wind chime.

Figure 2:
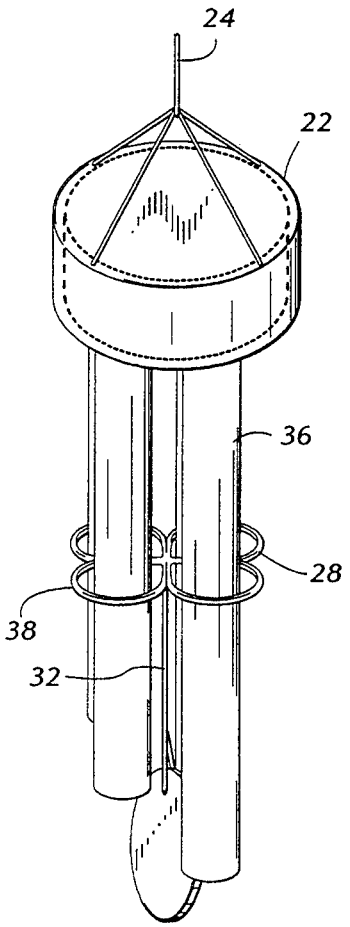
FIG. 2 is a perspective view of a wind chime incorporating another embodiment of the striker.

The frame as shown in FIG. 2 is an inverted bowl 22. The use of an inverted bowl collects and directs sound from the chimes. The frame could be any structure which can be hung or suspended from a line 24, and from which a plurality of chimes may be hung or suspended, but the bowl shaped frame directs the sound in a desirable manner.

As shown in FIG. 1, four chimes 6 are incorporated. Any number of chimes could be used, however, it is unusual to use fewer than three chimes, or more than six chimes.

Most commonly, the chimes are fabricated from hollow, metallic tubing. Tubing of the desired diameter is cut to the desired length. The tube which forms the chimes could be aluminum, copper, steel or other metal, or the tube could be fabricated from other materials which will produce a tone when struck by a striker. As shown in FIG. 1, the hollow tubes may be cut to different lengths to form chimes having different tone characteristics which results from the differing length, diameter, material or cross-sectional dimensions of the individual tubes.

The individual chimes are suspended from the frame. The chimes are suspended from the frame in a manner such that the chimes are allowed some freedom of movement relative to the frame, that is the chimes are allowed to swing on the line and be moved about, usually by the wind. A flexible line made of any suitable material from which objects are normally hung and which will allow movement or swinging of the individual chimes may be used. The use of the inverted bowl shaped frame shown in FIG. 2 not only collects and directs the sound, it also retains and limits movement of the chimes.

The novelty of the present invention is in the structure of the striker 8,28. The striker is comprised of a plurality of loops 18,38. The loops have a ring-like, annular shape, with an interior void. In the preferred embodiment, the loops are round, since the cross-section of the chimes in the preferred embodiment is round. Accordingly, the inside diameter of the loop, which forms the void within the loop, will be larger than the outside diameter of the horizontal cross-section of the chime so that the chime can extend through the loop as shown in the drawing figures. The loop could, however, be any shape, including triangular, rectangular, pentagonal, irregular, or otherwise, as long as a void of a sufficient size is present within the loop to allow extension of the chime through the loop.

The plurality of loops forms the striker. Each loop is adjoined to at least one other loop, as shown in FIG. 1, with the connected loops forming the striker. Each loop may be connected to two or more loops. As shown in FIG. 2, the plurality of loops is connected to form a clover leaf arrangement. The arrangement of the chimes dictates the particular formation of the striker.

A chime 6 extends through a loop 18. A chime may extend through multiple loops if multiple strikers are used, or if the striker is configured to comprise multiple loops through which a single chime could be extended. However, in the preferred embodiment, the striker has the same number of loops as the wind chime has chimes, which with each tube or chime extending through its corresponding loop of the striker. As shown in FIG. 1, each chime extends through a loop of the striker so that there are four chimes and four corresponding loops. Loops are adjoined side by side in a linear fashion to duplicate the linear alignment dictated by the hanging of the chimes from the frame. Again, in the embodiment shown in FIG. 2, each tube or chime extends through its corresponding loop of the striker. In this embodiment, the four chimes produce a four-sided boundary, and the striker configuration for the loops duplicates this grouping, producing what may be described as four-leaf clover shaped striker. It is not necessary for the number of chimes to equal the number of loops. For example, more than one chime could extend through a single loop. A plurality of chimes may be present, with the number of chimes exceeding the number of loops.

The loops may be formed of any suitable material. Normally, to produce a tone from the chime, a hard material, such as a metal is used to form the loops of the striker. Since the device may be used outside, metals which are resistant to corrosion are preferred, such as stainless steel, copper or brass. Other materials could be used, such as hard wood, plastic or hard rubber. Usually, for ease of manufacturing, the striker will be formed of loops each of which is of the same material. However, to produce different tones from the chimes, or for other reasons, loops could be formed of different materials.

It is not necessary for the loops to form a closed ring. The loops may be split. However, any split or gap within the ring should not be large enough to allow the individual chime to escape from within the interior of the loop as the chime and striker move about relative to each other.

The tone of the wind chime is produced by the striker 8 striking the chimes. As the wind chime is exposed to the wind, the wind moves the chimes about so as to strike the striker, but more importantly, the striker is moved about by the wind so as to strike the chimes. The swinging motion of the wind chime, the individual chime members, and the striker, produces sound from the wind chime. The striker strikes the chimes and rebounds to strike other chimes.

Movement of the striker is influenced by the clapper 10. Most commonly, the clapper is a plane or disk which is suspended horizontally for maximum exposure to the wind. The wind strikes the clapper, and as the clapper is moved about, it causes the striker to move about to strike the wind chimes, due to the communication between the clapper and the striker.

The striker is suspended within the boundary formed by the position of the chimes on the frame. The chimes may be positioned equidistantly about the frame, so that as shown in FIG. 2, the four tubes or chimes 36 form the corners of an imaginary square. As shown in FIG. 1, the chimes 6 are placed side by side so as to form a line.

The striker is suspended to allow substantial movement of the striker. Most commonly, a line 14, string, or similar flexible member hangs vertically, with the striker suspended therefrom. The striker could be suspended from the frame, or suspended from the line on which the wind chime is suspended.

The clapper is suspended so as to be positioned underneath the striker. The clapper is connected by a line 12,32 which is usually, although not necessarily, flexible, to allow the clapper to extend below the bottom of the chimes in the preferred structure. By suspending the clapper below the bottom of the chimes, maximum exposure to the wind is achieved.

The loops could be formed of different metals to produce different tones, or the loops could be of differing dimensions to produce different tones. The loops allow the chimes to move within the rings to strike the differing surface materials, without trapping and holding the hollow tube. The loops, while allowing freedom of movement within the loops, limit the travel of the chimes. The chimes 6,36 are inserted so as to extend through at least one of the loops, thereby limiting movement of the chimes. By limiting the movement of the chimes, damage to the wind chime apparatus is reduced in the event of high velocity wind situations. Further, the individual chimes will not become tangled about each other.

What is claimed is:

1. A wind chime, comprising:

a. a chime which is suspended generally vertically from above said chime; and b. a striker comprising a loop, wherein said chime extends through an interior void of said loop, and is retained within said interior void of said loop to limit movement of said chime to within said loop, and wherein said chime moves within said loop to strike said loop to produce a musical tone.

2. A wind chime as described in claim 1, further comprising a clapper which is suspended vertically below said striker.

3. A wind chime as described in claim 1, wherein said loop is metallic.

4. A wind chime, comprising:

a. a chime suspended generally vertically from above said chime; and b. a striker suspended from above said striker, comprising a member having an annular void therein, said chime extending through said annular void, said chime being retained within said annular void to limit movement of said chime to within said annular void, wherein said chime contacts said striker as said chime moves within said annular void to produce a musical tone.

5. A wind chime as described in claim 4, further comprising a clapper which is suspended vertically below said striker.

6. A wind chime as described in claim 4, wherein said multiplicity of member is metallic.

7. A wind chime as described in claim 4, comprising a plurality of chimes and a plurality of members, wherein each of said multiplicity of members abuts at least one other member of said multiplicity of members and is joined to at least one other member of said multiplicity of members.

8. A wind chime, comprising:

a. a frame;

b. a multiplicity of chimes suspended generally vertically from said frame and spaced apart and arranged to allow movement of said chimes; and c. a striker suspended from above said striker comprising a multiplicity of loops, wherein said multiplicity of chimes extends through and is surrounded by said multiplicity of loops, and said multiplicity of chimes is retained within said multiplicity of loops to limit movement of said multiplicity of chimes to within said multiplicity of loops, and wherein said multiplicity of chimes moves within said multiplicity of loops to strike said striker to produce a musical tone.

9. A wind chime as described in claim 8, further comprising a clapper which is suspended vertically below said striker.

10. A wind chime as described in claim 8, wherein said multiplicity of loops is metallic.

11. A wind chime as described in claim 8, wherein each of said multiplicity of loops abuts at least one other loop of said multiplicity of loops and is joined to at least one other loop of said multiplicity of loops.

* * * * *